United States Patent [19]

Platt

[11] Patent Number: 4,912,894

[45] **Date of Patent: * Apr. 3, 1990**

[54] INTERLOCKING CROSS TEE

[75] Inventor: William Platt, Collingdale, Pa.

[73] Assignee: National Rolling Mills, Inc., Malvern, Pa.

[ * ] Notice: The portion of the term of this patent subsequent to May 9, 2006 has been disclaimed.

[21] Appl. No.: 346,962

[22] Filed: May 4, 1989

Related U.S. Application Data

[63] Continuation-in-part of Ser. No. 93,853, Sep. 8, 1987, Pat. No. 4,827,681, which is a continuation-in-part of Ser. No. 935,762, Nov. 28, 1986, Pat. No. 4,785,603.

[51] Int. Cl.[4] ..... E04C 2/42

[52] U.S. Cl. ..... 52/98; 52/232; 52/667

[58] Field of Search ..... 52/484, 667, 98, 232

[56] References Cited

U.S. PATENT DOCUMENTS

| | | | |
|---|---|---|---|
| 4,489,529 | 12/1984 | Ollinger et al. | 52/484 X |
| 4,685,262 | 8/1987 | Meredith, Jr. | 52/484 X |
| 4,712,350 | 12/1987 | Vukmanic | 52/778 X |
| 4,727,703 | 3/1988 | Platt | 52/484 X |
| 4,827,681 | 5/1989 | Platt | 52/484 X |

*Primary Examiner*—David A. Scherbel
*Assistant Examiner*—Lan Mai
*Attorney, Agent, or Firm*—Eugene Chovanes

[57] ABSTRACT

A fire-resistant suspended ceiling grid structure having cross tees interlocked to main beams, to support ceiling tiles. The structure has shear means to permit a cross tee to expand into a main beam during a fire. The interlock includes tongues held in an abutting relationship by open belt loops. The tongues slide to permit the cross tees to expand longitudinally during a fire.

2 Claims, 6 Drawing Sheets

FIG. 6
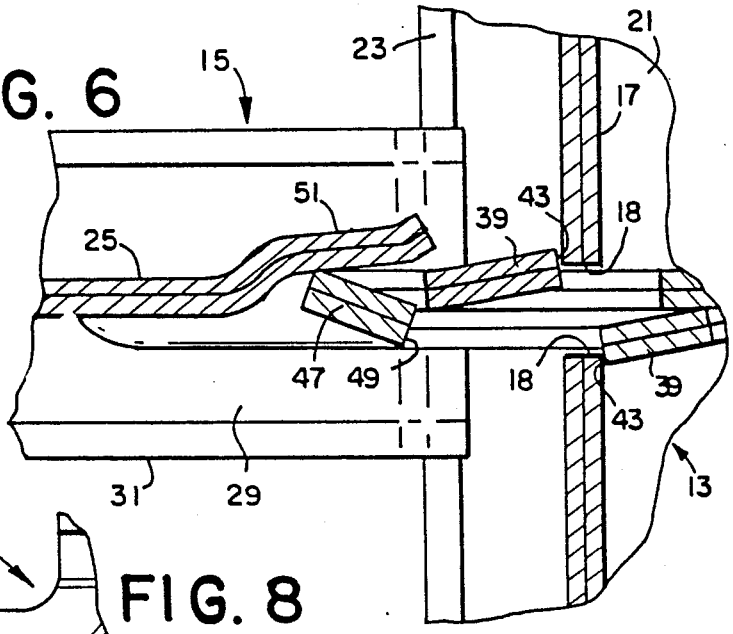
FIG. 8
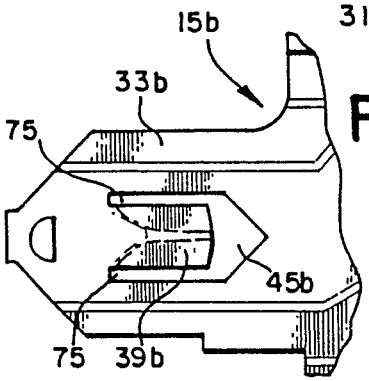
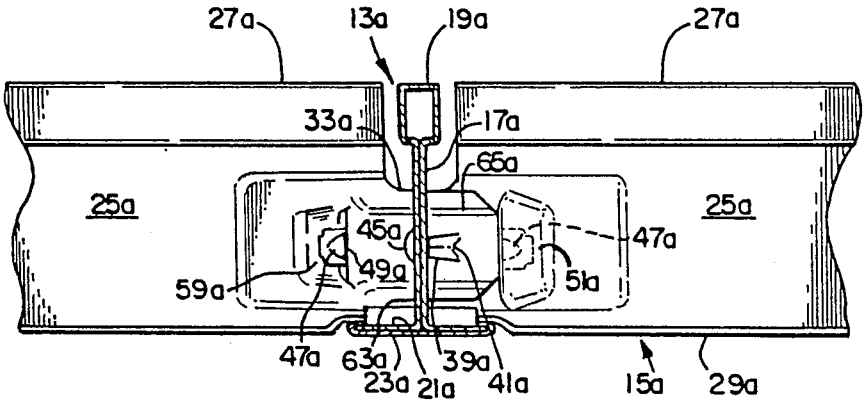
FIG. 7

INTERLOCKING CROSS TEE

This is a continuation-in-part of application Ser. No. 093,853 filed Sept. 8, 1987 for INTERLOCKING CROSS TEE, now U.S. Pat. No. 4,827,681, granted May 9, 1989 which is a continuation-in-part of application Ser. No. 935,762 filed Nov. 28, 1986 for INTERLOCKING CROSS TEE, now U.S. Pat. No. 4,785,603 granted Nov. 22, 1988.

BACKGROUND OF THE INVENTION

1. Field of the Invention

This invention relates to improvements in a suspended ceiling grid structure adapted to support ceiling tiles or the like, and more particularly concerns improvements in such structures in connecting means between elements of the grid structure.

The claims of Pat. No. 4,785,603 relate to a seismic-resistant ceiling. The invention claimed in U.S. Pat. No. 4,827,681 and herein are directed to a fire-resistant ceiling.

2. Description of the Prior Art

Seismic-resistant as well as fire-resistant suspended ceiling grid structures for supporting ceiling tiles are known in the art. Typically, such grid structures have a plurality of parallel main beams or runners connected together at right angles by a plurality of cross tees. The main beams and cross tees are made of metal that is generally thin, so that even when the main beams and cross tees are constructed with a double thickness of such metal, the connecting means may fail when subjected to high levels of tension, such as the vibrations caused by seismic disturbances. The metal also has an appreciable positive temperature coefficient of expansion and, consequently, the main beams and cross tees tend to expand from the heat generated by the fires, causing the grid structure to twist and bend and drop the ceiling tiles.

Various efforts have been made in the prior art for modifying suspended ceiling grid connnections means for accommodating the stress of contraction and expansion so as to maintain the proper support of ceiling boards even during a condition of excessive vibration as would be caused by a seismic disturbance or a condition of excessive heat as would be caused by a fire. The prior art proposals to accommodate, and hence avoid, the adverse effects of undue stress in the connecting means of a cross tee grid structure have involved the use of locking tabs to lock a cross tee to a main beam after the cross tee has been inserted through a slot in the main tee. In addition, the cross tees of such a structure have been made to interlock to increase the resistance of such cross tees to forces tending to pull them apart. However, such connecting means in some instances required the use of clips to lock the connecting means together, or a separate end connector made of higher strength steel shaped to the end of the web.

The use of reinforcing clips to lock the connection between cross tees and main beams of a suspended ceiling structure adds undesirably both to inventory and installation problems as well as to cost of materials. The use of these clips in some instances has been necessary, however, because interlocking cross tees and locking tabs of cross tees known in the art have not been strong enough to withstand high compression and tension forces.

Another problem has been how to provide interlocking cross tees with a means for easy disengagement from the interlocked postion for removal of such cross tees without damage.

SUMMARY OF THE INVENTION

There is formed at the end of a cross tee in a ceiling grid system a tongue intended to pass through a slot in a main runner and lock to the main runner. The cross tee can stay fixed to the main runner alone, as in an area of the ceiling close to a wall, or as is generally the case, can interlock with the tongue on another cross tee which is inserted through the slot on the main runner from the opposite side thereof. The tongue on one end of the cross tee passes through a belt loop on the adjacent cross tee, whereby a tongue in one cross tee is held against the tongue on an adjacent cross tee in an overlapping relationship. Various stops provide for positive locking. The invention provides a strong connection to prevent separation in the event of seismic disturbances. By providing a shear tab, and an open belt loop, the invention yields a fire-rated ceiling which permits staged expansion so that the ceiling can remain sufficiently intact during a fire to keep the ceiling tile in place. The tile, or boards, provide a fire-retardant, or containment effect.

Accordingly, among the objects of the invention is the provision of an improved ceiling grid system including main beam and cross tee connecting means that is operative to accommodate the stress of the forces caused by excessive vibrations from a seismic disturbance, or the stress of the expansion forces caused by heat during a fire, in a manner that does not detract from the rigidity of the grid structure and its capacity to support the ceiling boards without sagging.

A further object of the invention is to provide a fire-resistant ceiling capable of staged expansions at the opposite ends of the cross tees whereby a controlled expansion takes place at one end of a cross tee before controlled expansion takes place at the opposite end of the tee.

A further purpose is to control the expansion of a cross tee during a fire without having the ceiling collapse.

A further purpose is to provide shear tabs in a suspended ceiling construction to permit controlled longitudinal expansion of the cross members so that the metallic cross tees and main runners can continue to support the ceiling tiles during a fire, thus utilizing the fire-resistant qualities of the ceiling construction during the fire.

A further purpose is to provide an open belt loop which holds the adjacent tongues in overlapping and interlocking relationship in normal use, and which permits expansion of the cross tees in the event of a fire.

Further purposes appear in the specifications and drawings.

BRIEF DESCRIPTION OF THE DRAWINGS

FIGS. 1 through 8 show the grid structure claimed in my application Ser. No. 935,762 (now U.S. Pat. No. 4,785,603) dealing with a seismic-resistant ceiling.

FIG. 1 is a fragmentary view in perspective of a suspended ceiling grid structure constructed in accordance with the invention.

FIG. 2 is a view in section as indicated by the lines and arrows 2—2 which appear in FIG. 1;

FIG. 3 is a view in section as indicated by the lines and arrows 3—3 which appear in FIG. 1;

FIG. 4 is a view in section as indicated by the lines and arrows 4—4 which appear in FIG. 3;

FIG. 5 is a fragmentary view in perspective to two oppositely disposed interlocking cross tees and a main beam before the cross tees are inserted into the main beam;

FIG. 6 is an enlarged view of a portion of the connecting means shown in FIG. 4;

FIG. 7 is a view partly in section of another embodiment of the invention;

FIG. 8 is a detail view of an alternative embodiment of the connecting tongue of the invention.

FIG. 9 is a view similar to FIG. 5, showing in perspective two oppositely disposed interlocking cross tees and a main beam, before the cross tees are inserted into the main beam.

FIG. 10 shows the connection assembled, similar to the view of FIG. 3.

FIG. 11 is a view similar to FIGS. 5 and 9, showing in perspective two oppositely disposed interlocking cross tees and a main beam, before the cross tees are inserted into the main beam.

FIG. 12 shows the connection assembled, similar to the views of FIGS. 3 and 10.

DETAILED DESCRIPTION

FIGS. 1 through 8

Figure 1:
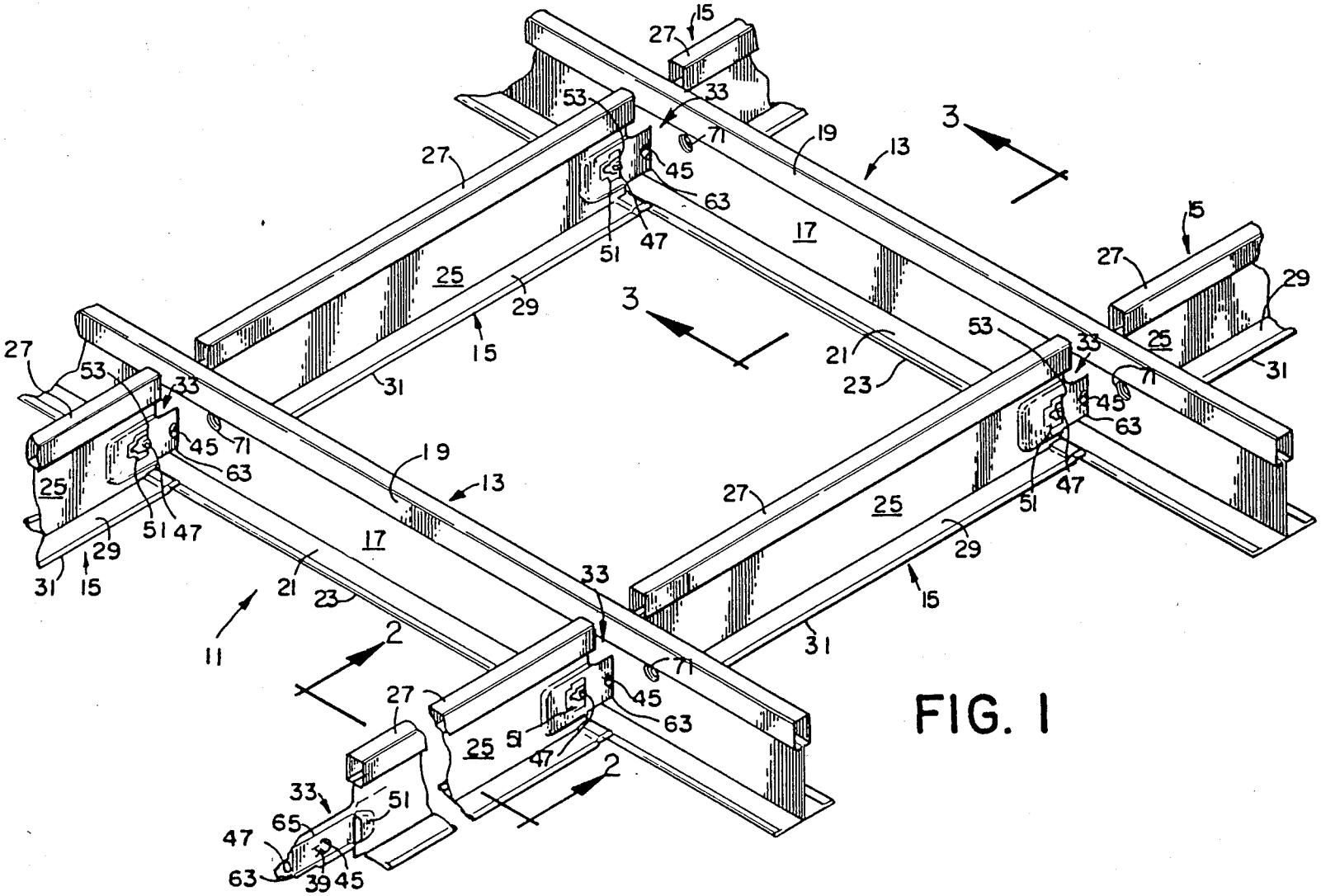
Figure 2:
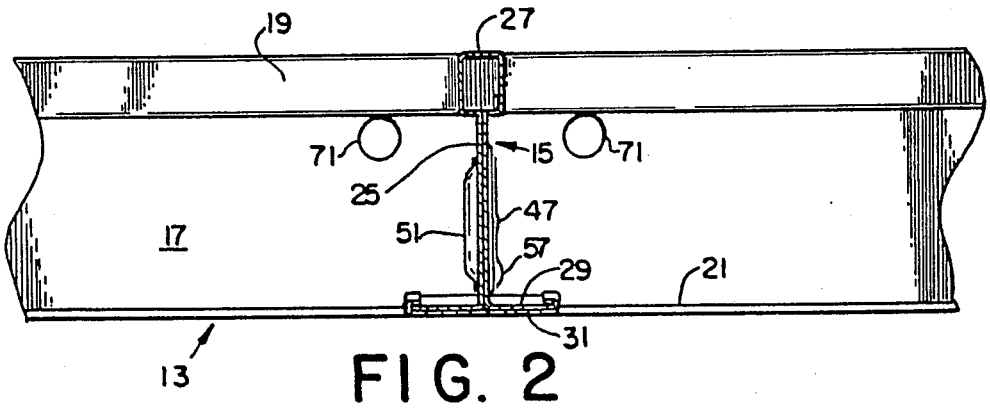
Figure 3:
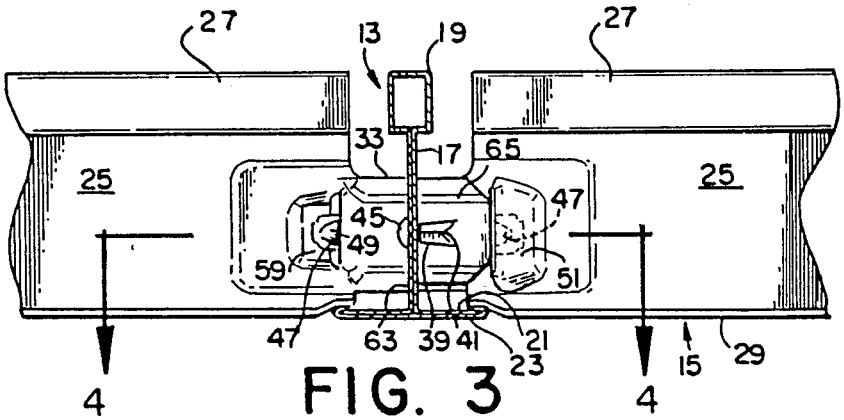
Figure 4:
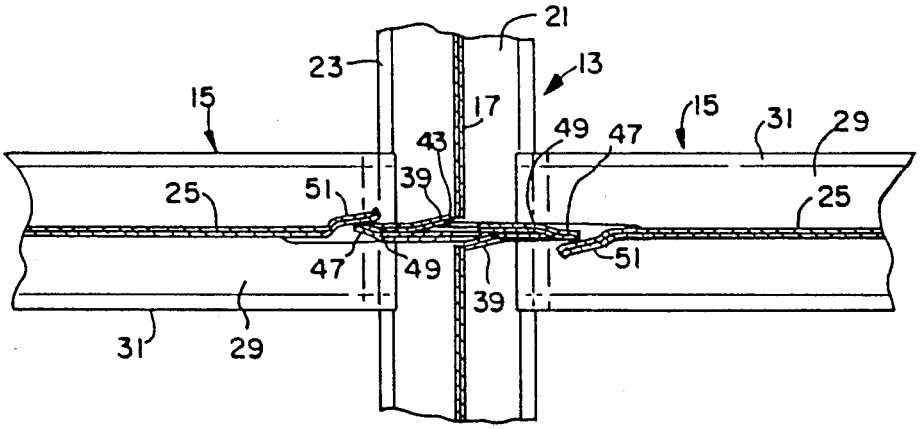
Figure 5:
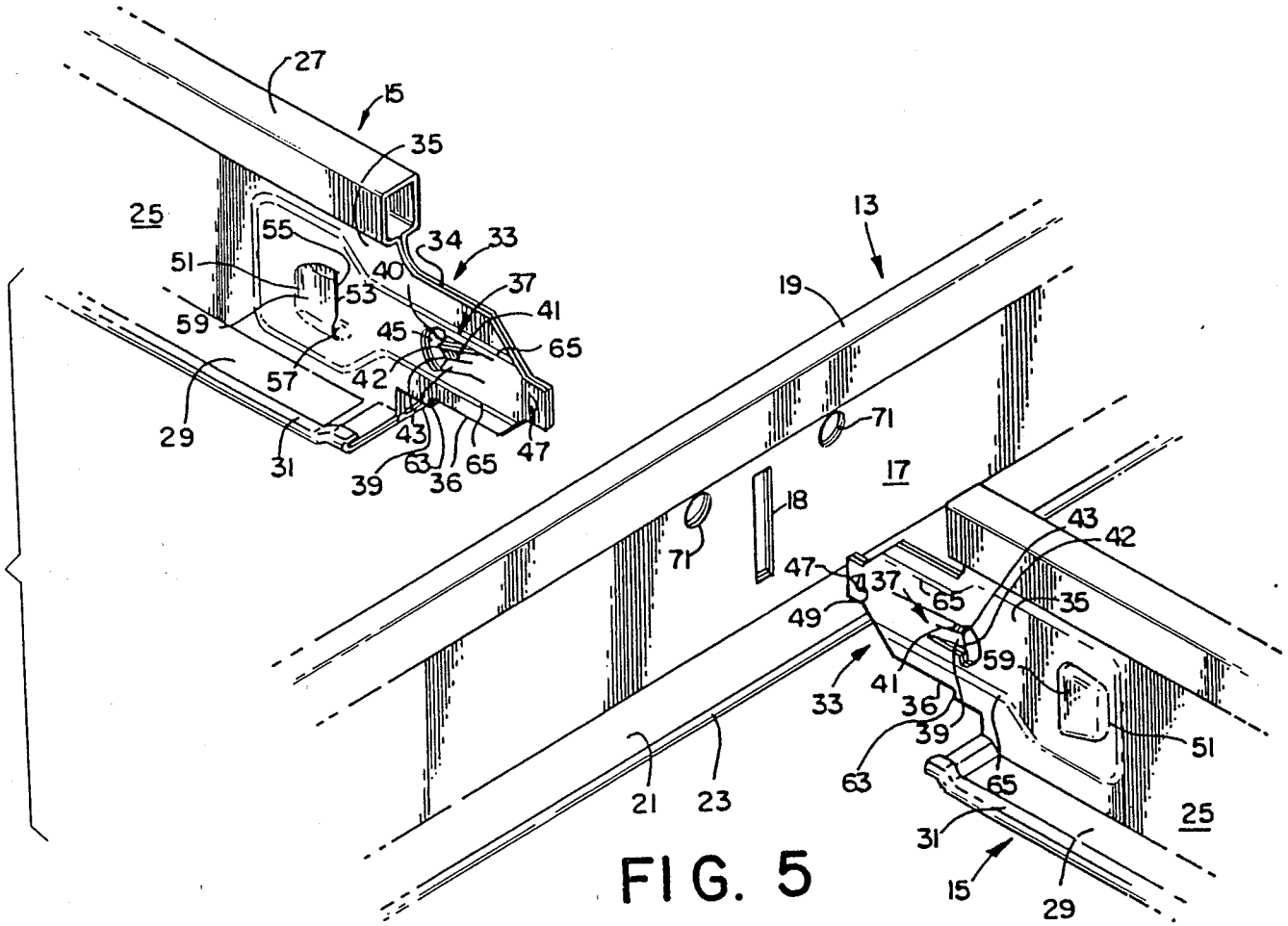

In FIGS. 1 through 8, there is shown the invention as directed to a seismic-resistant ceiling. A suspended ceiling grid structure 11 supports ceiling tiles or the like. The structure 11 comprises a plurality of main beams or runners 13 arranged in a spaced-apart, substantially parallel relationship, and cross tees 15 which connect adjacent main beams 13 together.

Each main beam 13 has an inverted T shape, and includes a central fin or web 17 having a reinforced bead or bulb 19 at the top and a pair of oppositely disposed flanges 21 at the bottom. An ornamental cap 23 is mounted on the bottom of flanges 21.

Cross tees 15 are also of inverted T construction and each includes a central fin or web 25, a reinforcing bead or bulb 27 at the top of central web 25, an ornamental cap 31 mounted on the bottom of flanges 29, and a connecting tongue 33 extending from each end 35 of a web 25. The tongue 33 is preferably offset from the center plane of the web 25 by approximately one-half thickness of the web 25.

On each tongue 33 of the cross tees 15 is provided a locking means 37, of such configuration that either end of a cross tee 15 may be locked to a slot 18 provided in a main beam 13 to which a cross tee 15 is connected in the suspended ceiling grid structure 11. The locking means 37 on each tongue 33 comprises a locking tab 39 and an opening 45. The locking tab 39 is formed in the tongue 33 and extends laterally outwardly from the tongue 33 to create a locking tab edge 43 whereby when a cross tee 15 is locked to main beam 13, the locking tab edge 43 of the tongue 33 engages the central web 17 of the main beam 13. A tab spine or crease 41 is formed in the center of locking tab 39 so that the locking tab 39 is V-shaped in cross section, with the locking tab edges 42 extending away from, and the tab spine 41 being close to, the tongue 33. The V-shape in cross section of the locking tab 39 greatly increases the resistance of the cross tee 15 to pull-apart forces.

The opening 45 is formed axially away from the locking tab edge 43 of the locking tab 39 whereby when a tongue 33 is inserted through a slot 18 of a main beam 13, the locking tab 39 flexes back into the cavity 40 it left when the locking tab 39 was punched, and flexes into the opening 45. The opening 45, which is preferably D-shaped, is provided because when a tab 39 is punched through sheet metal, it is larger than the cavity it leaves. If the opening 45 were not present, the locking tab 39 could not flex back when inserted through the slot 18 of the main beam 13, because edge 43 would strike the metal of the web 25.

Each cross tee 15 further includes interlocking means of such configuration that either end of a cross tee 15 may be interlocked with a similarly constructed but oppositely disposed cross tee 15. The interlocking means comprises an interlocking fingernail 47 formed in and extending laterally outwardly from the tongue 33 and in a direction opposite to the projection of locking tab 39. The interlocking fingernail 47 is preferably formed by depressing the metal and making only a vertical cut or incision in the tongue 33 whereby an interlocking fingernail edge 49 is produced.

The interlocking means further includes a fingernail interlocking pocket 51 formed in and extending laterally outwardly from the central web 25 of the cross tee 15. The fingernail interlocking pocket 51 is preferably formed by depressing the metal and making only a vertical cut or incision on the central web 25 of the cross tee 15, which creates a fingernail interlocking pocket edge 53 that has a top portion 55 and a bottom portion 57 for engaging the interlocking fingernail edge 49 of a connecting cross tee 15.

The fingernail interlocking pocket 51 includes an offset or raised portion 59 that extends away from and axially along the central web 25 for a distance to form the pocket, whereby a connecting tongue 33 of an interconnected cross tee 15 is not severely bent or deformed when inserted into the interlocked position.

Another feature of the interlocking means is that the bottom portion 57 of the fingernail interlocking pocket edge 53 is flared laterally outwardly in a direction opposite to the direction of the extension of the fingernail interlocking pocket 51 by an amount approximating the thickness of an interlocking fingernail 47 whereby the tongue 33 of the cross tee 15 and the tongue 33 of a simialrly constructed but oppositely disposed cross tee 15 may be disengaged from the interlocked relationship by moving the interlocked cross tees 15, 15 so that an interlocking fingernail 47 of one cross tee 15 passes through the interlock release pocket 57 of the opposite cross tee 15.

Each cross tee 15 additionally includes a tee stop shoulder or notch 63 formed in the bottom edge 36 of tongue 33 for abutting the central web 17 of the main beam 13 when the cross tee 15 is inserted through the slot 18 in the central web 17.

The cross tees 15 are also provided with stiffening ribs 65 that reinforce and greatly strengthen the ends of cross tees 15 and connecting tongues 33.

In the embodiment of the invention shown in FIG. 7, the reinforcing bulb or bead 27*a* of each cross tee 15*a* extends axially to a position whereby when cross tees 15*a* are connected to a main beam 15*a*, the bulbs 27*a* of the cross tees 15*a* more nearly abut the bulb 19*a* of the main beam 13*a*.

FIG. 8 shows another embodiment of the invention where two slits 75 are formed in the tongue 33*b* of the cross tee 15*b*. The slits 75 are formed above and below the locking tab 39*b* and provide additional clearance so that the sides of the locking tab 39*b* do not strike the metal of the tongue 33*b* when the locking tab 39*b* flexes back into the cavity 40*b* as the cross tee 15*b* is inserted through the slot 18 of the main beam 13. The opening 45*b* of this embodiment is triangle-shaped, and is contiguous with the slits 75 so that the opening 45*b* and the slits 75 have a combined U-shaped appearance.

Hanger holes 71 are formed in the central web 17 of main beam 13, and are adapted to receive wire hangers that support the grid structure.

In operation, main beams 13 are suspended from the ceiling by wire hangers attached to hanger holes 71, and cross tees 15 are locked to main beams 13 by sliding the connecting tongues 33 through slots 18 so that the locking tab edges 43 and tee stop shoulders 63 abut central web 17 of main beam 13. Additionally, the connecting tongues 33 slide into the fingernail locking pockets 51 of oppositely disposed cross tees 15 far enough so that the edge 49 of the interlocking fingernail 47 slides over and then abuts or engages the edge 53 of the fingernail interlocking pocket 51.

When the suspended ceiling grid structure 11 is subjected to severe tension as caused by the excessive vibrations of a seismic disturbance, the locking tab 39 of a cross tee 15 exerts pressure against the central web 17 of the main beam 13. Also, the interlocking fingernail edge 49 of a cross tee 15 exerts pressure against the fingernail interlocking pocket edge 53 of a similarly constructed but oppositely disposed interlocked cross tee 15. Further, interlocking fingernail 47 of a cross tee 15 exerts pressure against the raised portion 59 of the fingernail interlocking pocket 51 of a similarly disposed interlocked cross tee 15.

Figure 10:
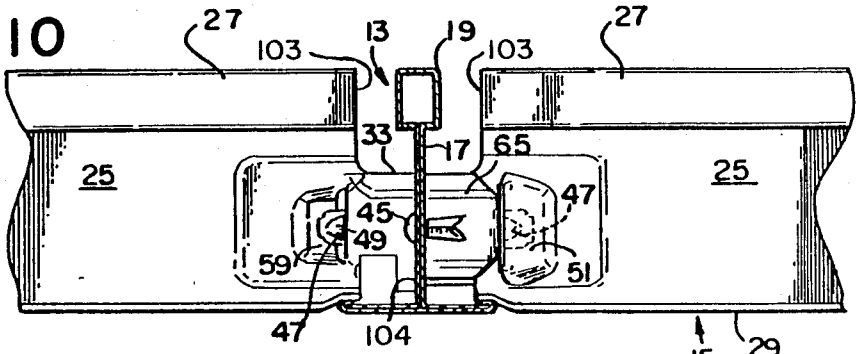
FIGS. 9 and 10 show a grid structure which deals with a fire-resistant ceiling.
Figure 9:
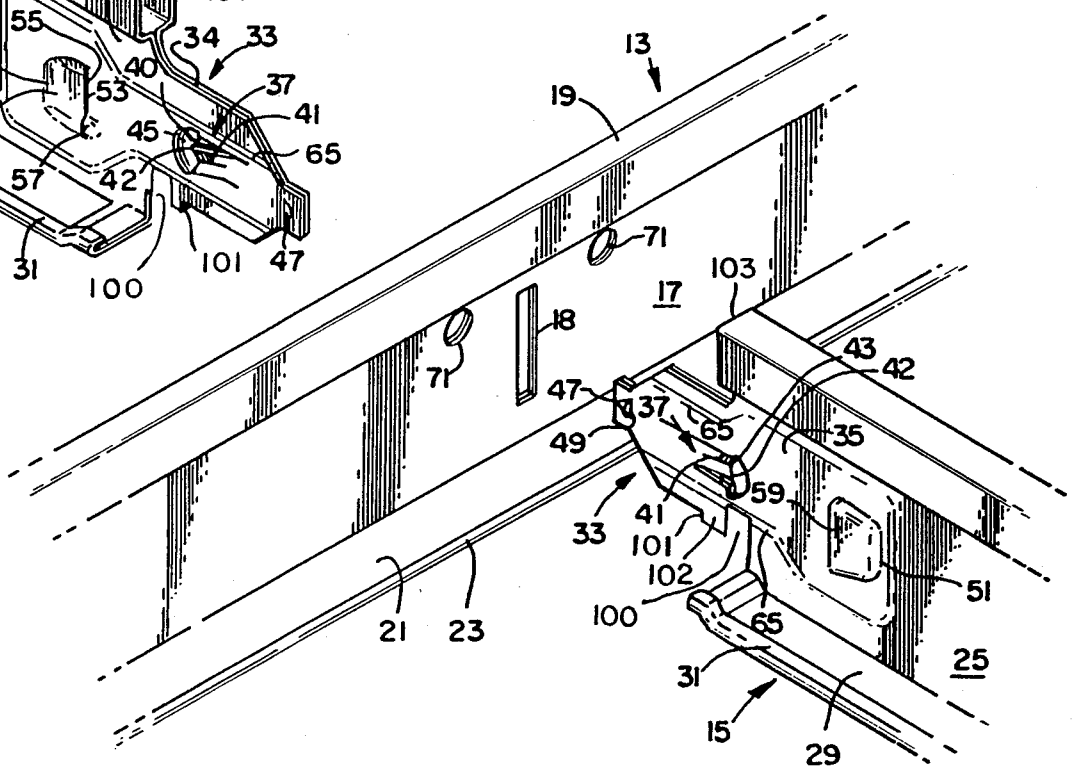
Figure 9:
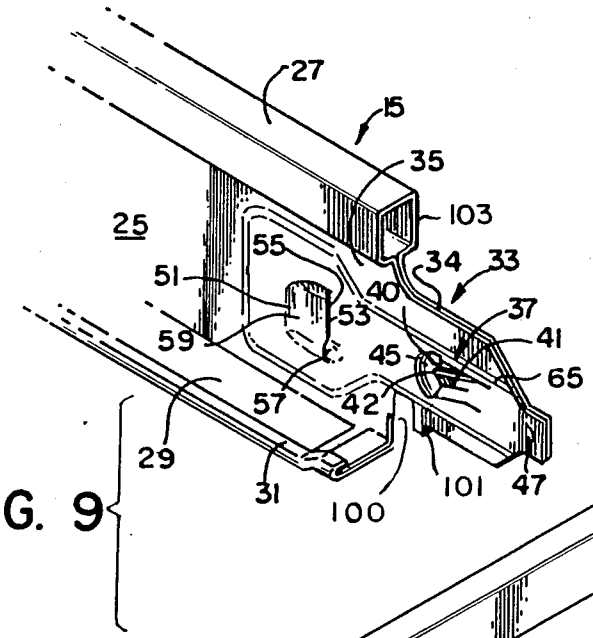

FIGS. 9 and 10

In FIGS. 9 and 10, I show the invention as directed to a fire-resistant ceiling. The connection is essentially the same as that showing FIGS. 1 through 8, except a notch 100 exists behind shoulder 101, whereby a shear tab 102 is formed.

Additionally, the web 25 can be recessed to a greater depth at 103.

In the event of a fire, cross tee 15 expands longitudinally, whereby shear tab 102 is forced against the web of the main runner at 104. The cross tee continues to expand, shearing off tab 102 as the tongue 33 is forced deeper into pocket 51.

The tongue 33 will be received in pocket 51 and seated therein, whereby further expansion will be resisted.

As further expansion of the cross tee continues from the heat of the fire, the tab 102 at the opposite end of the cross tee 15 will bend, or shear, permitting tongue 33 to pass through slot 18 until tongue 33 is restrained by pocket 51.

Such controlled, staged expansion permits the expansion to take place in, for instance, increments of $\frac{1}{8}$ to $\frac{1}{4}$ inches.

In the event further expansion of the cross tee 15 continues, pocket 51 will yield, particularly where the metal has desirably been suitably weakened in fabrication, as by slitting. The ceiling continues to be generally intact, even after the pocket yields, since a still further stop occurs when web 25 abuts the main runner at point 103.

Thus, a controlled, staged expansion of the ceiling grid system occurs, which continuously supports the tile or boards, thus providing a fire-resistant barrier during a fire.

The tab is such that it shears or breaks under a 35 lb. force in a cold condition, and the pocket parts at a force of 55 lb. in a cold condition. In an actual fire, the forces would vary depending on the heat of the metal.

Figure 11:
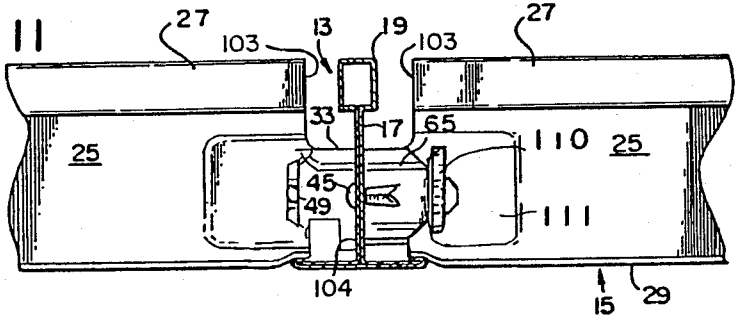
FIGS. 11 and 12 show the grid structure claimed herein, which deals with a fire-resistant ceiling.
Figure 13:
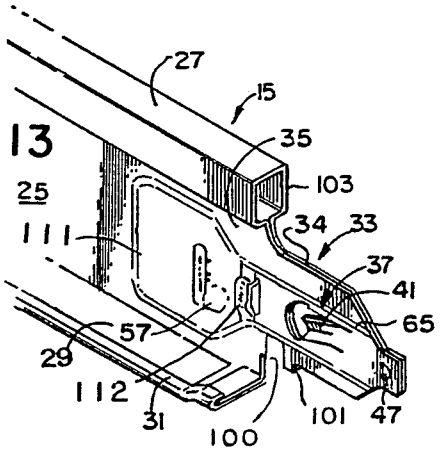
FIG. 13 is a partial view of the web showing a punched-out stake to keep the layers of the web together.
Figure 12:
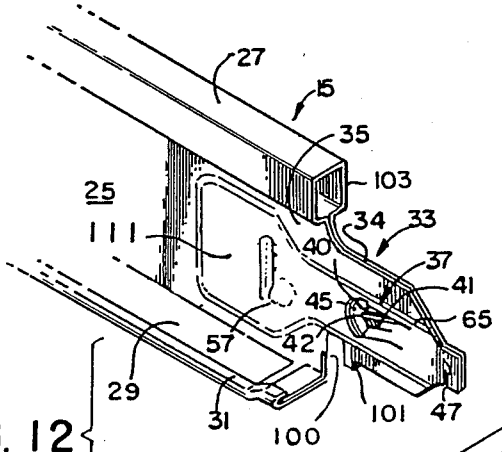
Figure 12:
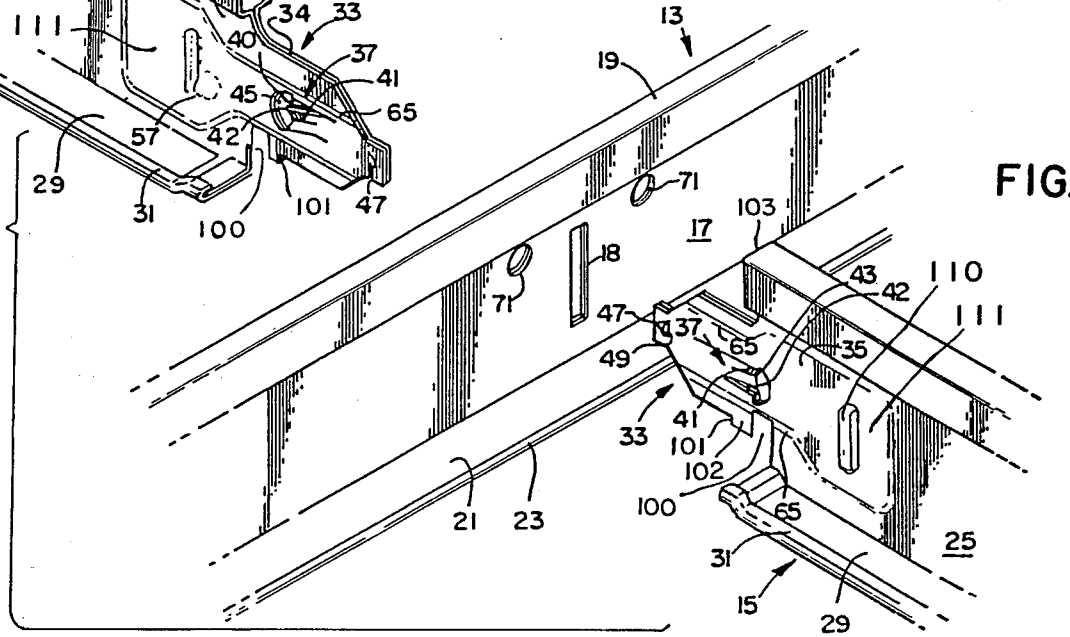

FIGS. 11 and 12

In FIGS. 11 and 12, I show the invention of FIGS. 9 and 10 with the pocket 51 modified to provide an open belt loop 110 with an offset portion of web 111 behind the belt loop 110. Whereas the pocket 51 of FIGS. 9 and 10 limits expansion of cross tee 15 when the end of tongue 33 reaches the closed end of pocket 51 during a fire, belt loop 110 of the present invention presents no such barrier to expansion. The loop 110, however, serves to keep the tongues 33 in overlapping relation during normal conditions, as well as during a fire. In normal conditions, such overlapping relationship is necessary in order to keep interlocking fingernail 47 in engagement with the end of tongue 33. This keeps the cross tees 15 from being pulled apart longitudinally from one another. During a fire, the belt loop 110 keeps the adjacent tongues 33 overlapped, while permitting the tongues 33 to slide over each other to permit longtudinal expansion of the cross tees 15. The offset portion 111 of the web 17 eliminates any interference from the web with the end of the expanding tongue 31.

There is also shown a punched-out stake 112 which serves to keep the two layers of web 17 together by a staking or stitching effect.

The cross tees 15 will continue to expand during a fire until either bulb end 103 of the end of flange 29, or both, come into abutting relation with main beam 13.

Expansion occurs in stages, as explained in the embodiments of FIGS. 9 and 10.

ADVANTAGES

The suspended ceiling grid structure 11 of the invention is provided with increased strength at the interconnection or coupling between a main beam 13 and a cross tee 15, such increased strength being obtained without the use of heavier gauge metal for the webs 17 of the main beam 13 or the use of clips to lock a cross tee 15 to a main beam 13. This improvement in strength is obtained from the interlock between fingernail 47 and interlocking pocket 51 or belt loop 110.

There is also provided an improved cross tee 15 featuring an opening 45 on a tongue 33 to allow the locking tab 39 to flex back when the cross tee 15 is inserted into the slot 18 of a main beam 13. If this opening 45 is no punched out behind the locking tab 39, the locking tab 39 would not be able to flex back because when a tab is punched through sheet metal, the size of the tab is larger than the size of the opening created by the punch.

There is also provided an improved cross tee featuring an interlocking fingernail 47 and a fingernail interlocking pocket 51 or belt loop 110. When two similarly constructed but oppositely disposed cross tees 15 are interlocked, the resistance of the interlocked cross tees 15 to pull-apart forces is greatly increased. Additionally, an interlock release pocket 57 is provided in the bottom portion of the fingernail interlocking pocket edge 53. The interlock release pocket 57 allows two similarly constructed but oppositely disposed cross tees 15 to become easily disengaged from the interlocked position without any damage to either cross tee 15.

The fire-resistant ceiling structure of FIGS. 9 and 10, in addition to the above advantages, permits a controlled expansion of the cross tees whereby the metallic support structure can remain generally intact to hold the tile or boards in place. Such expansion occurs when the shear tabs are bent or sheared whereby the cross tee can expand through the slot in the main runner. The main runner is suitably modified to provide for its own expansion as by relief notches or the like, in the known prior art manner.

The modified fire-resistant ceiling structure of FIGS. 11 and 12 has belt loops instead of pockets to keep the tongues overlapped and permit expansion without interference from a pocket having a closed end.

I claim:

1. In a suspended ceiling grid structure, a cross tee (15) having an inverted T cross section comprising an elongated central web (25) with a bulb (27) at the top and with a pair of oppositely disposed flanges (29) extending outwardly from the bottom of the web (25) and adapted to support ceiling tiles, a connecting tongue (33) extending from an end of the web (25), the tongue (33) being offset from the center of the web by approximately one-half the thickness of the web (25), locking means (37) formed in the tongue (33) for locking said cross tee (15) to a slot (18) provided in a main beam (13) to which the cross tee (15) is connected in the ceiling grid, an interlocking means (47, 110) formed in the tongue (33) and web (25) for interlocking the cross tee (15) with interlocking means of a similarly constructed but oppositely disposed cross tee (15) when the cross tees (15) are inserted into the slot (18) from opposite directions, and shear means (101,102) on the tongue (33) that stop the cross tee (15) from further entering the slot (18) at normal room temperatures, and shears or bends during a fire, comprising (A) a tab portion (102) extending transversely of the tongue (33), and (B) a notch portion (101) adjacent the tab portion (192) on the side away from the end of the tongue (33) whereby, the cross tee (15) is permitted to expand during a fire, wherein the tab portion (102) shears or bends into the notch portion (101), the improvement comprising a belt loop (110) in the interlocking means (47, 110) that keeps the tongues (33) in overlapped and interlocked relationship under normal conditions, and that permits the tongues (33) to slide in an overlapped relationship so that the cross tees (15) can expand longitudinally during a fire.

2. The ceiling grid structure of claim 1 wherein the web (25) is formed of a plurality of metal layers held together by a stake (112) punched from the web (25).

* * * * *